US009385454B2

(12) United States Patent
Hashiguchi

(10) Patent No.: US 9,385,454 B2
(45) Date of Patent: Jul. 5, 2016

(54) CONNECTOR AND CONNECTOR ASSEMBLY INCLUDING A PLURALITY OF CONTACTS WHICH ARE SEPARATED FROM EACH OTHER AND ARE ARRANGED IN A PITCH DIRECTION PERPENDICULAR TO A CONNECTION DIRECTION

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/685,082

(22) Filed: Apr. 13, 2015

(65) Prior Publication Data

US 2015/0340781 A1 Nov. 26, 2015

(30) Foreign Application Priority Data

May 23, 2014 (JP) ..... 2014-107059

(51) Int. Cl.

| | |
|---|---|
| ***H01R 12/00*** | (2006.01) |
| ***H01R 12/70*** | (2011.01) |
| ***H01R 4/02*** | (2006.01) |
| *H01R 12/57* | (2011.01) |

(52) U.S. Cl.

CPC ..... *H01R 12/7076* (2013.01); *H01R 4/02* (2013.01); *H01R 12/57* (2013.01)

(58) Field of Classification Search

CPC ..... H01R 12/57

USPC ..... 439/65, 83

See application file for complete search history.

(56) References Cited

U.S. PATENT DOCUMENTS

| | | | | |
|---|---|---|---|---|
| 3,693,052 | A * | 9/1972 | Galanti | H05K 1/141 174/260 |
| 5,569,056 | A * | 10/1996 | Raimond | H01L 23/49811 257/E23.068 |
| 6,093,036 | A * | 7/2000 | Tohgo | H01R 9/091 174/261 |
| 6,942,500 | B2 * | 9/2005 | Chen | H01Q 1/1207 248/510 |

FOREIGN PATENT DOCUMENTS

| | | | |
|---|---|---|---|
| JP | 2001160442 | A | 6/2001 |
| JP | 2003197297 | A | 7/2003 |
| JP | 2013033598 | A | 2/2013 |

* cited by examiner

*Primary Examiner* — Tho D Ta

(74) *Attorney, Agent, or Firm* — Holtz, Holtz & Volek PC

(57) ABSTRACT

A connector is to be fixed to a principal surface of a connection object and to be connected with a mating object. The connector comprises a plurality of contacts and a guide member. Each of the contacts has a first soldered portion, a first main portion and a first auxiliary portion. The first main portion has a contact portion. The guide member has a second soldered portion, a second main portion and second auxiliary portion. The second main portion has a guide portion which guides the mating object. When the first soldered portions and the second soldered portion are soldered to the principal surface, the contacts are arranged in a pitch direction while being separated from one another, and the guide member is separated from the contacts. The first auxiliary portion and the second auxiliary portion have cross-sections same as each other in a plane perpendicular to the pitch direction.

9 Claims, 14 Drawing Sheets

CONNECTOR AND CONNECTOR ASSEMBLY INCLUDING A PLURALITY OF CONTACTS WHICH ARE SEPARATED FROM EACH OTHER AND ARE ARRANGED IN A PITCH DIRECTION PERPENDICULAR TO A CONNECTION DIRECTION

CROSS REFERENCE TO RELATED APPLICATIONS

An applicant claims priority under 35 U.S.C. §119 of Japanese Patent Application No. JP2014-107059 filed May 23, 2014.

BACKGROUND OF THE INVENTION

This invention relates to a connector which comprises a plurality of contacts separated from one another.

For example, this type of connector is disclosed in JP-A 2001-160442 (Patent Document 1), the content of which is incorporated herein by reference.

As shown in FIG. 26, the connector of Patent Document 1 comprises a plurality of contacts. The contacts are fixed on a circuit board while being separated from one another. These contacts are to be connected to the respective patterned electrodes of a mating circuit board.

The connector of Patent Document 1 has a problem of unsatisfactory operability in connecting process.

SUMMARY OF THE INVENTION

It is therefore an object of the present invention to provide a connector which comprises a plurality of contacts separated from one another and which can be improved in its operability in connecting process.

One aspect of the present invention provides a connector which is to be fixed to a principal surface of a connection object and which is to be connected with a mating object in a connection direction, wherein the mating object comprises a guided portion. The connector comprises a plurality of contacts and a guide member. The contacts and the guide member are obtained by punch-pressing a single metal plate. Each of the contacts has a first soldered portion, a first main portion and a first auxiliary portion. The first soldered portion has two ends in a predetermined direction. The first main portion extends from one of the ends of the first soldered portion and has a contact portion. The contact portion is a portion which is to be brought into contact with the mating object. The first auxiliary portion extends from a remaining one of the ends of the first soldered portion. The guide member has a second soldered portion, a second main portion and a second auxiliary portion. The second soldered portion has two ends in the predetermined direction. The second main portion extends from one of the ends of the second soldered portion and has a guide portion. The guide portion is a portion which is to position the mating object in a direction perpendicular to the connection direction and to guide the mating object along the connection direction. The second auxiliary portion extends from a remaining one of the ends of the second soldered portion. When the connector is fixed to the principal surface, the first soldered portions and the second soldered portion are soldered to the principal surface, the predetermined direction extends in parallel to the principal surface, the contacts are arranged in a pitch direction perpendicular to the predetermined direction while being separated from one another, and the guide member is separated from the contacts. The first auxiliary portion and the second auxiliary portion have cross-sections same as each other in a plane perpendicular to the pitch direction.

Another aspect of the present invention provides a connector assembly comprising the connector and a mating connector. The mating object comprises a mating connection object and the mating connector which is to be fixed to the mating connection object. The mating connector is provided with the guided portion.

According to the present invention, because the guide member is provided to guide the mating object during connection, operability in connection can be improved. Moreover, the guide member is obtained by punch-pressing the metal plate common to the contacts, and the first auxiliary portion and the second auxiliary portion have the cross-sections same as each other in the plane perpendicular to the pitch direction. Since this guide member can be formed by using the pressing process for the formation of the contacts, addition of the guide member does not cause extreme increase in cost.

An appreciation of the objectives of the present invention and a more complete understanding of its structure may be had by studying the following description of the preferred embodiment and by referring to the accompanying drawings.

Figure 1:
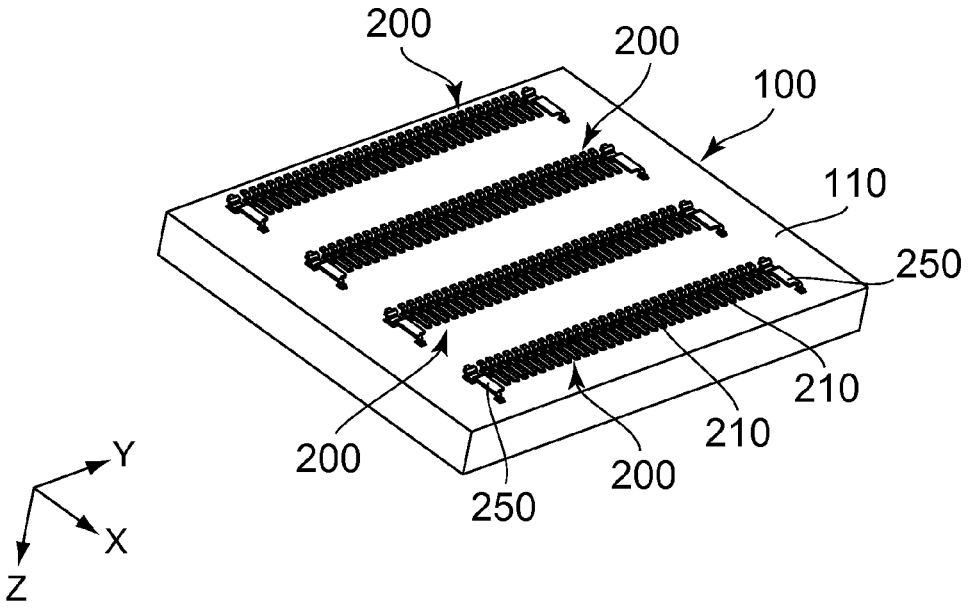
FIG. 1 is a perspective view showing a connector according to a first embodiment of the present invention, wherein the connector is fixed to a connection object.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIG. 1, a connector 200 according to a first embodiment of the present invention is to be fixed to a principal surface 110 of a connection object 100. The connection object 100 of the present embodiment is a semiconductor package. In the present embodiment, the number of the connectors 200 which are fixed to the connection object 100 is four. However, in the present invention, the number of the connectors 200 is not limited thereto.

Figure 3:
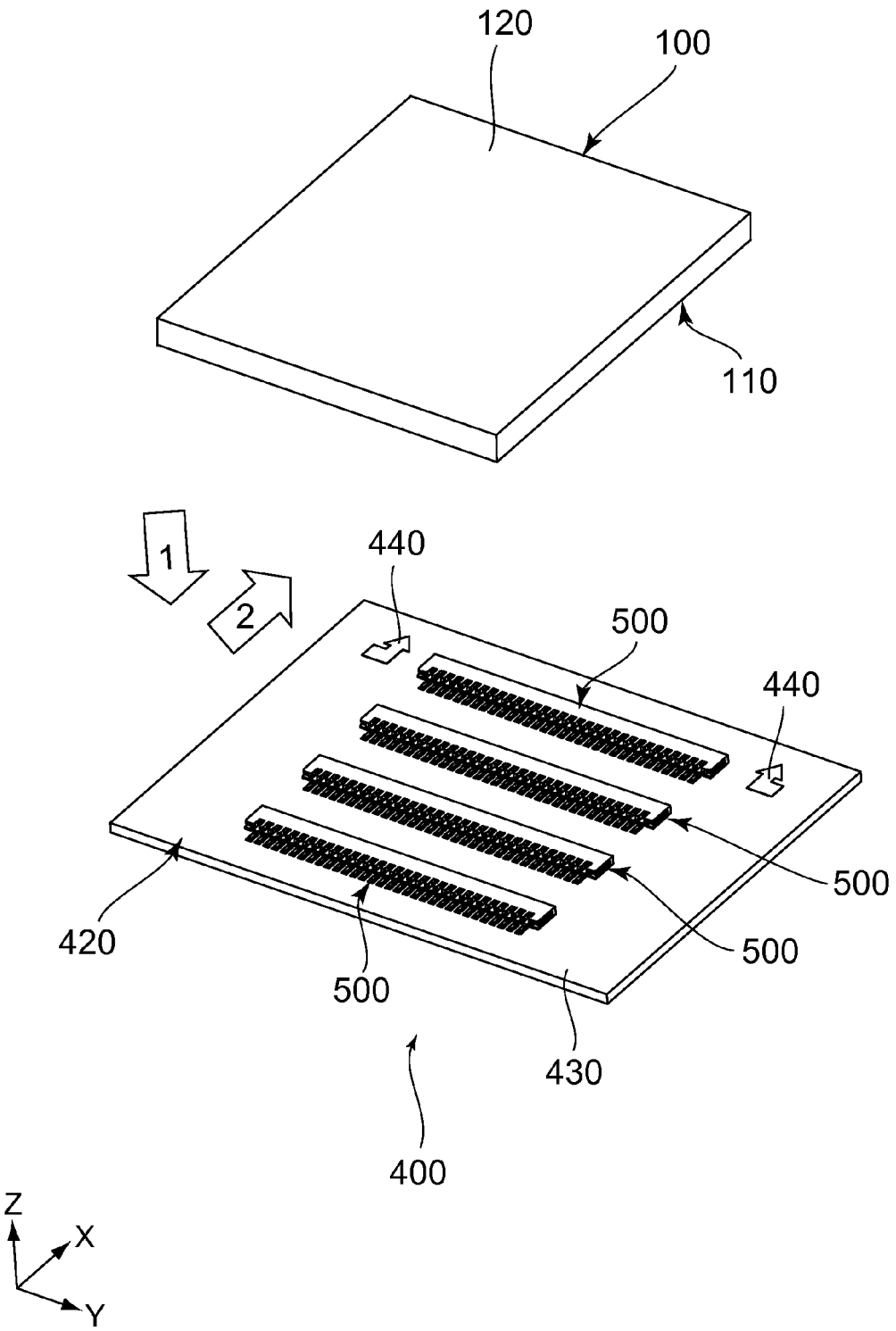
FIG. 3 is a perspective view showing a method for connecting the connector fixed to the connection object with the mating object, wherein the connector is hidden behind the connection object and cannot be viewed, and the mating object is constituted of a mating connection object and the mating connector fixed thereto.

As can be seen from FIGS. 1 and 3, the connector 200 is to be connected with the mating object 400 in the X-direction. In other words, in the present embodiment, the X-direction is a connection direction along which the connector 200 and the mating object 400 are connected with each other.

As shown in FIG. 3, the mating object 400 of the present embodiment comprises a mating connection object 420 and a mating connector 500 which is to be fixed to a principal surface 430 of the mating connection object 420. In the present embodiment, the number of the mating connectors 500 which are fixed to the mating connection object 420 is four. However, in the present invention, the number of the mating connectors 500 is not limited thereto.

Figure 2:
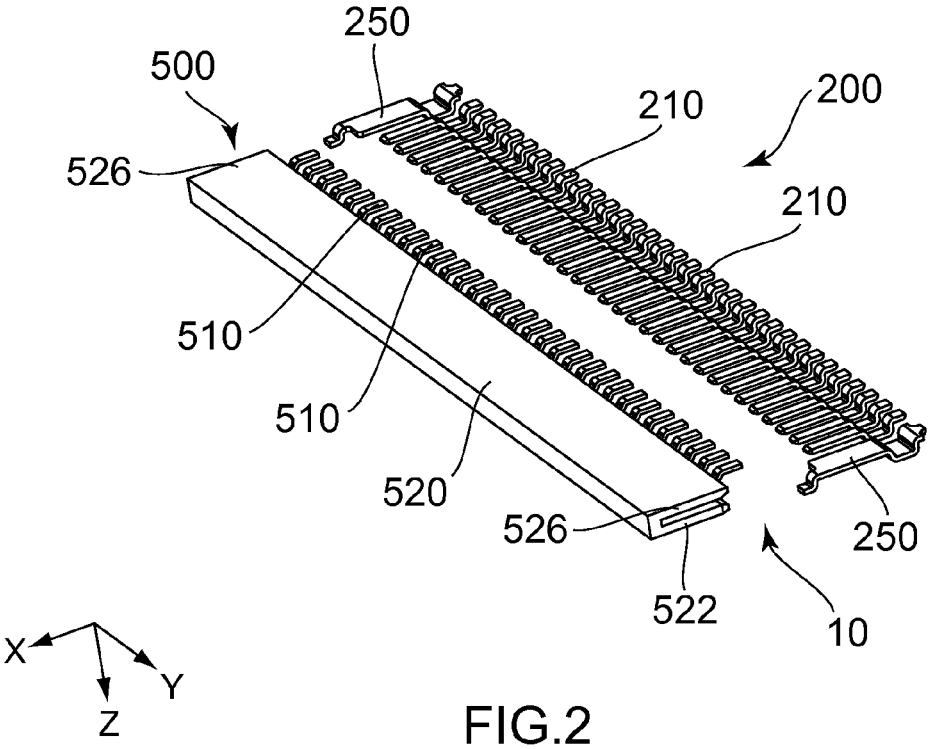
FIG. 2 is a perspective view showing a connector assembly comprising the connector of FIG. 1 and a mating connector.

A connector assembly 10 of the present embodiment comprises one connector 200 and one mating connector 500 (see FIG. 2). In the present embodiment, four connector assemblies 10 (see FIG. 2) are used to connect the connection object 100 (see FIG. 1) and the mating connection object 420 (see FIG. 3) with each other.

The mating connection object 420 according to the present embodiment is a circuit board. As can be seen from the fact that the connection object 100 is a semiconductor package, the connection object 100 and the mating connection object 420 according to the present embodiment have thermal expansion coefficients different from each other.

The mating connection object 420 has two markers 440 formed on the principal surface 430, wherein the markers 440 are used when the connector 200 (see FIG. 1) and the mating connector 500 are connected with each other. How to connect the connector 200 with the mating connector 500 will be described in detail afterward.

Figure 4:
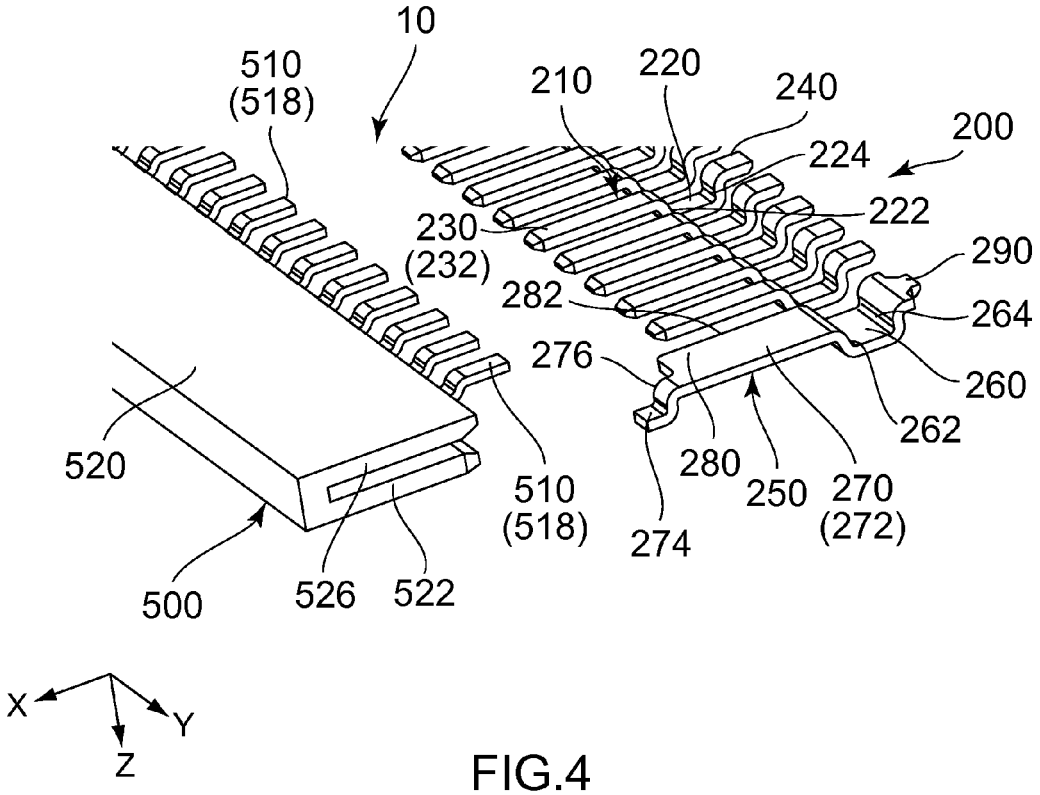
FIG. 4 is an enlarged, perspective view showing a part of the connector assembly of FIG. 2, wherein the connector and the mating connector are unconnected with each other.
Figure 12:
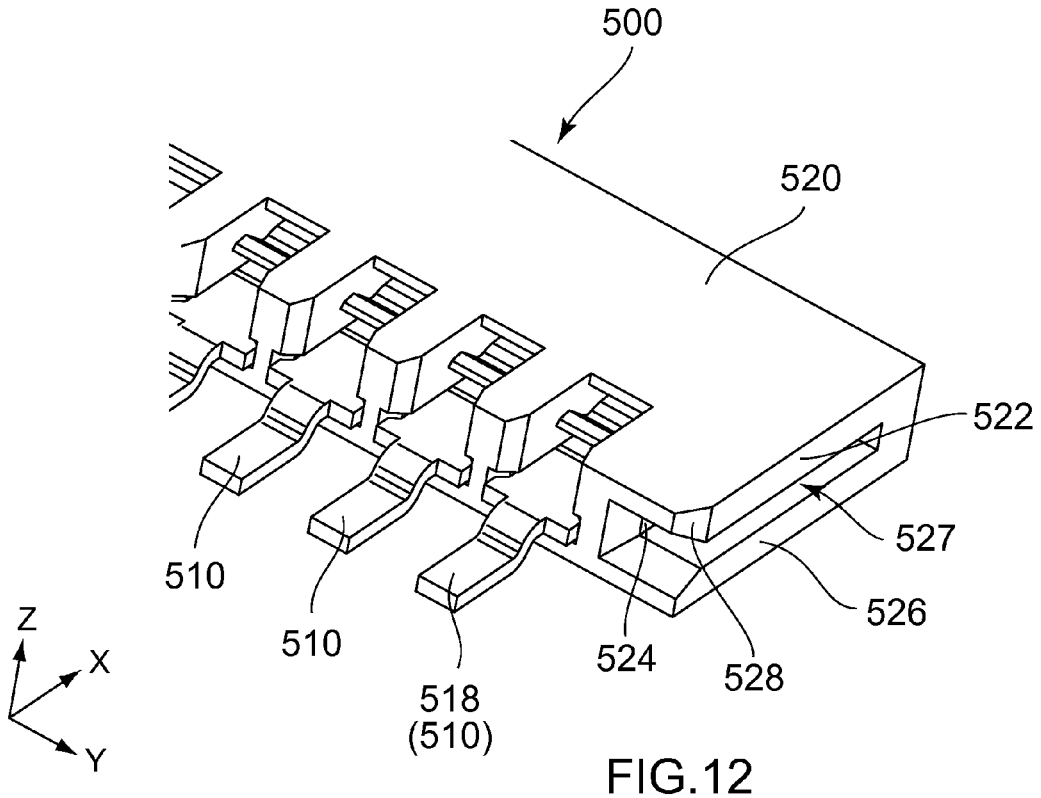
FIG. 12 is an enlarged, perspective view showing a part of the mating connector of FIG. 2.

As shown in FIGS. 4 and 12, each of the mating connectors 500 comprises a plurality of mating contacts 510 and a holding member 520 which holds these mating contacts 510 together. The holding member 520 of the present embodiment is made of resin which has a thermal expansion coefficient nearly equal to another thermal expansion coefficient of the circuit board that forms the mating connection object 420 (see FIG. 3). The mating contacts 510 are arranged in a pitch direction (Y-direction) by the holding member 520.

Figure 15:
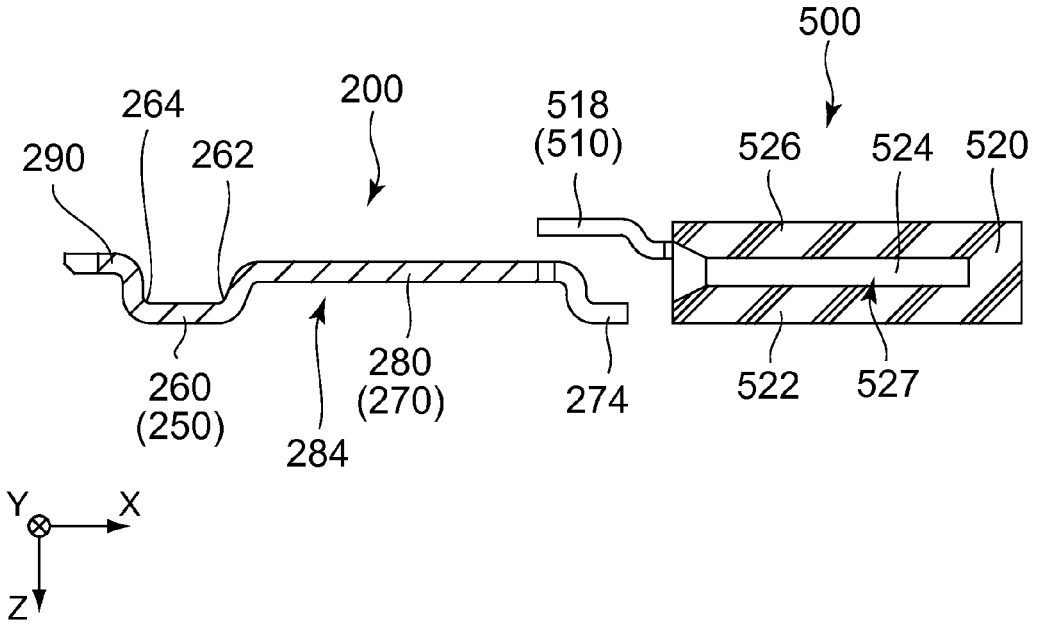
FIG. 15 is a cross-sectional view showing the connector assembly of FIG. 6, taken along line B-B, wherein the connector and the mating connector are unconnected with each other.

As can be seen from FIGS. 2 and 12, the holding member 520 is formed with two guided sets each constituted of one guided portion 522 and one auxiliary guided portion 526. The two guided sets are located at opposite ends of the holding member 520 in the Y-direction, respectively. In other words, for each of the guided sets, both the guided portion 522 and the auxiliary guided portion 526 are located at one of the opposite ends of the holding member 520 in the Y-direction. As shown in FIG. 12, each of the guided portion 522 and the auxiliary guided portion 526 of the present embodiment has a narrow and long plate-like shape extending in the XY-plane. For each of the guided sets, the guided portion 522 and the auxiliary guided portion 526 are located apart from each other in a perpendicular direction (Z-direction). In other words, a space 527 is formed between the guided portion 522 and the auxiliary guided portion 526. The guided portion 522 and the auxiliary guided portion 526 are coupled to each other at the positive X-side of the holding member 520. As can be seen from FIGS. 12 and 15, a separation wall is provided for each of the spaces 527. This separation wall is located between the mating contact 510 and the space 527. As described later, this separation wall has a face which faces the space 527 and functions as an additional guided portion 524. The guided portion 522 has a chamfered portion 528 formed at a corner in the negative X-side thereof.

Figure 13:
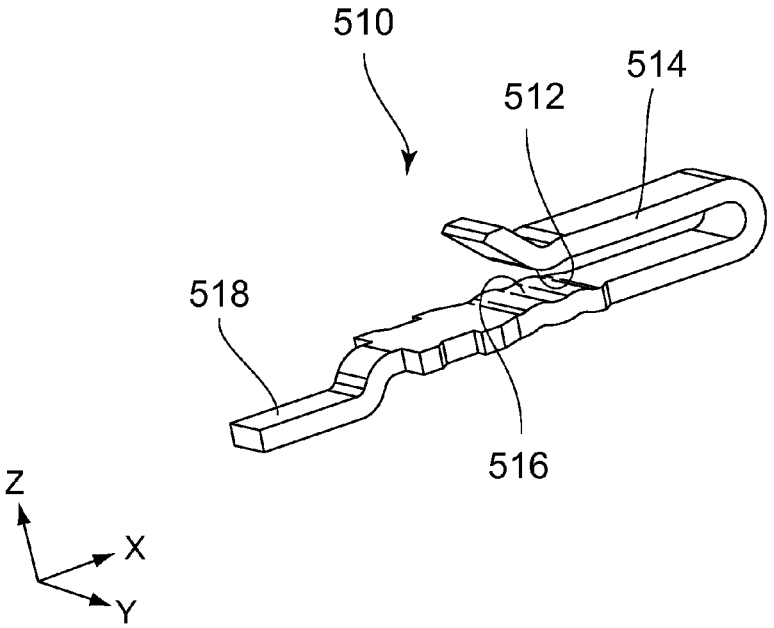
FIG. 13 is a perspective view showing a mating contact of the mating connector of FIG. 12.
Figure 14:
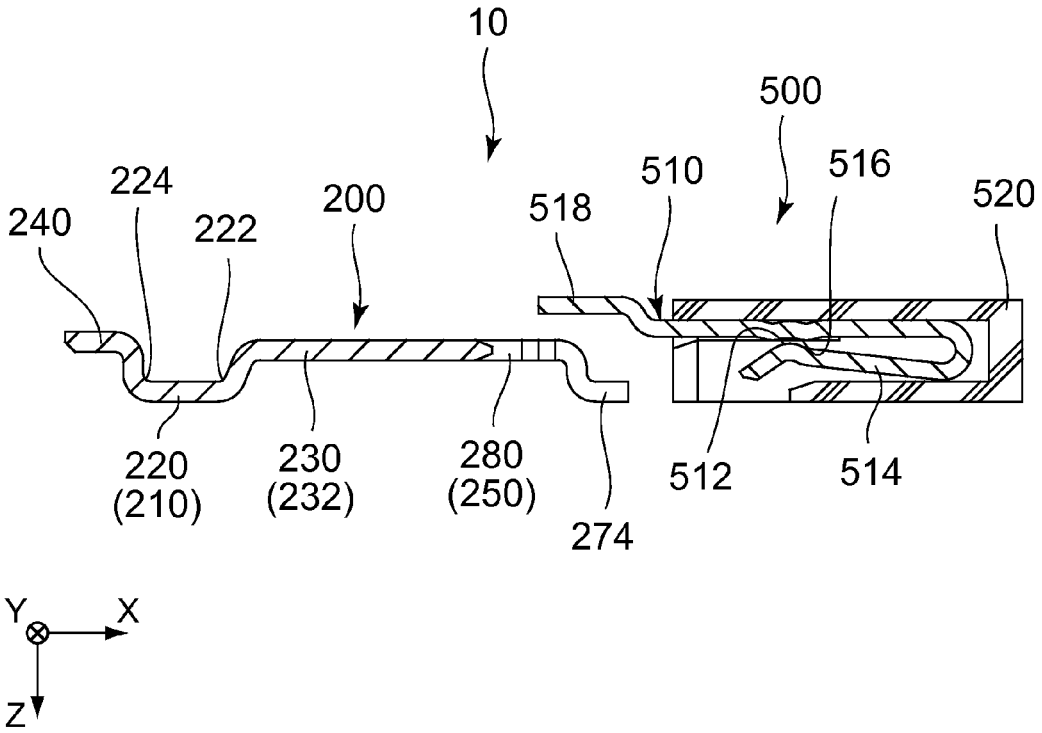
FIG. 14 is a cross-sectional view showing the connector assembly of FIG. 6, taken along line A-A, wherein the connector and the mating connector are unconnected with each other.
Figure 16:
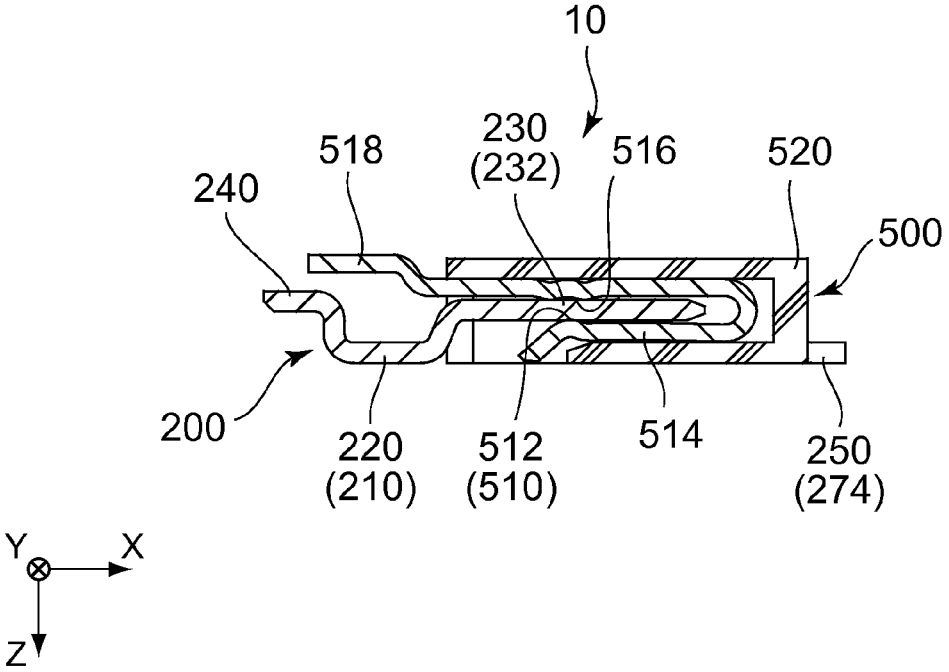
FIG. 16 is a cross-sectional view showing the connector assembly of FIG. 6, taken along line A-A, wherein the connector and the mating connector are connected with each other.
Figure 17:
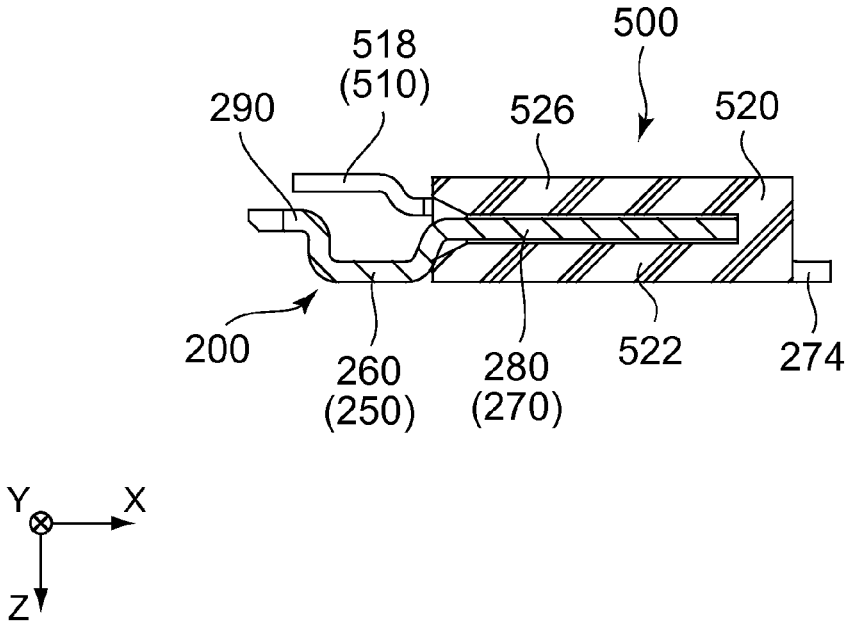
FIG. 17 is a cross-sectional view showing the connector assembly of FIG. 6, taken along line B-B, wherein the connector and the mating connector are connected with each other.

As shown in FIGS. 13, 14 and 16, the mating contact 510 has a mating contact portion 512, a spring portion 514, a receiving portion 516 and a fixed portion 518. The spring portion 514 resiliently supports the mating contact portion 512 so that the mating contact portion 512 is movable mainly in the Z-direction. The receiving portion 516 faces the mating contact portion 512 in the Z-direction. Although the receiving portion 516 of the present embodiment is formed as a part of the mating contact 510, the present invention is not limited thereto. The receiving portion 516 may be formed separately from the mating contact 510. For example, the receiving portion 516 may be formed as a part of the holding member 520. The fixed portion 518 is to be soldered to the principal surface 430 (see FIG. 3) of the mating connection object 420.

As can be seen from FIGS. 12 and 13, the mating contact 510 of the present embodiment is press-fit into the holding member 520. However, the present invention is not limited thereto. The mating contact 510 may be held by the holding member 520 via another method such as insert-molding.

Referring to FIG. 2, each of the connectors 200 comprises a plurality of contacts 210 and two guide members 250.

Figure 7:
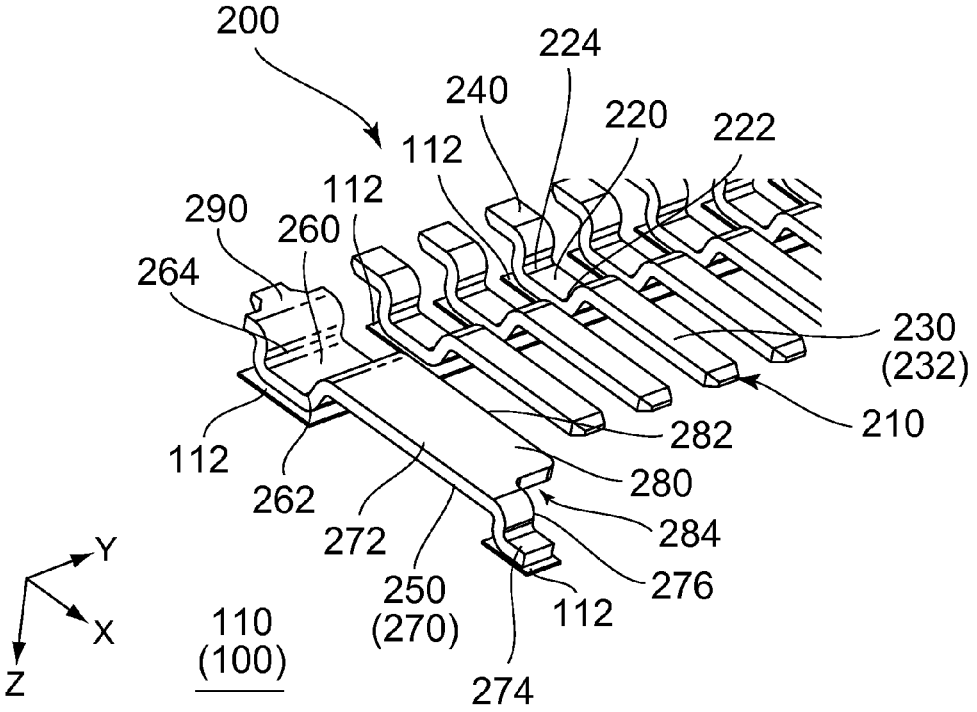
FIG. 7 is an enlarged, perspective view showing a part of the connector of FIG. 1.

The contacts 210 are arranged in a row in the Y-direction, and the guide members 250 are located at opposite sides of the row of the contacts 210 in the Y-direction, respectively. In other words, the contacts 210 are located between the two guide members 250 in the Y-direction. As shown in FIGS. 1 and 7, when the connector 200 is fixed to the principal surface 110 of the connection object 100, the contacts 210 are soldered to the principal surface 110 while being separated from one another, and each of the guide members 250 is soldered to the principal surface 110 while being separated from the contacts 210. In other words, each of the contacts 210 and the guide members 250 is integrated with neither other contacts 210 nor other guide members 250 and is soldered to the principal surface 110 of the connection object 100 while being separated into pieces. As can be seen from this fixing method, a movement of each of the contacts 210 and the guide members 250 is regulated only by its portion soldered to the principal surface 110 of the connection object 100. Accordingly, in the present embodiment, each interval between the contacts 210 and another interval between the contact 210 and the guide member 250 can be varied depending on thermal expansion or thermal shrinkage of the connection object 100. Further description will be made later about the fixing method by which the contacts 210 and the guide members 250 are soldered to the principal surface 110 of the connection object 100.

As shown in FIGS. 4, 7 and 14, each of the contacts 210 has a first soldered portion 220, a first main portion 230 and a first auxiliary portion 240. The first soldered portion 220 has two ends 222 and 224 in a predetermined direction (X-direction). When the connector 200 is fixed to the principal surface 110 of the connection object 100, the first soldered portion 220 is soldered to a pad 112 provided on the principal surface 110, and the predetermined direction extends in parallel to the principal surface 110. As can be seen from this explanation, the predetermined direction in the present embodiment is a direction same as the connection direction. The first main portion 230 extends from the end 222 which is one of the opposite ends of the first soldered portion 220. As shown in FIG. 16, the first main portion 230 has a contact portion 232 which is to be brought into contact with the mating contact portion 512 of the mating connector 500. In other words, the contact portion 232 is a portion which is to be brought into contact with a part of the mating object 400 (see FIG. 3). As can be seen from FIGS. 4 and 7, the contact portion 232 has a long and narrow plate-like shape. The contact portion 232 extends in the XY-plane that is defined by the X-direction and the Y-direction. In other words, the contact portion 232 extends in parallel to the principal surface 110 of the connection object 100. The first auxiliary portion 240 extends from the end 224 which is a remaining one of the opposite ends of the first soldered portion 220. In detail, the first auxiliary portion 240 extends from the first soldered portion 220 to be apart from the principal surface 110. In the X-direction, a size of the first auxiliary portion 240 is smaller than a half of another size of the first main portion 230. In other words, the first auxiliary portion 240 is shorter than the first main portion 230.

In the present embodiment, when the connector 200 is fixed to the principal surface 110, a size of the guide member 250 in the Z-direction (perpendicular direction) perpendicular to the principal surface 110 is same as a size of the contact 210 in the perpendicular direction. In other words, in the present embodiment, a height of the guide member 250 is same as a height of the contact 210.

As can be seen from FIGS. 4 and 7, each of the guide members 250 has a second soldered portion 260, a second main portion 270 and a second auxiliary portion 290. The second soldered portion 260 has two ends 262 and 264 in the X-direction. When the connector 200 is fixed to the principal surface 110 of the connection object 100, the second soldered portion 260 is soldered to the pad 112 provided on the principal surface 110. The second main portion 270 extends from the end 262 which is one of the opposite ends of the second soldered portion 260. The second auxiliary portion 290 extends from the end 264 which is a remaining one of the opposite ends of the second soldered portion 260. In detail, the second auxiliary portion 290 extends from the second soldered portion 260 to be apart from the principal surface 110. As can be seen from FIGS. 4 and 7, in the X-direction, a size of the second auxiliary portion 290 is smaller than a half of another size of the second main portion 270. In other words, the second auxiliary portion 290 is shorter than the second main portion 270.

Figure 5:
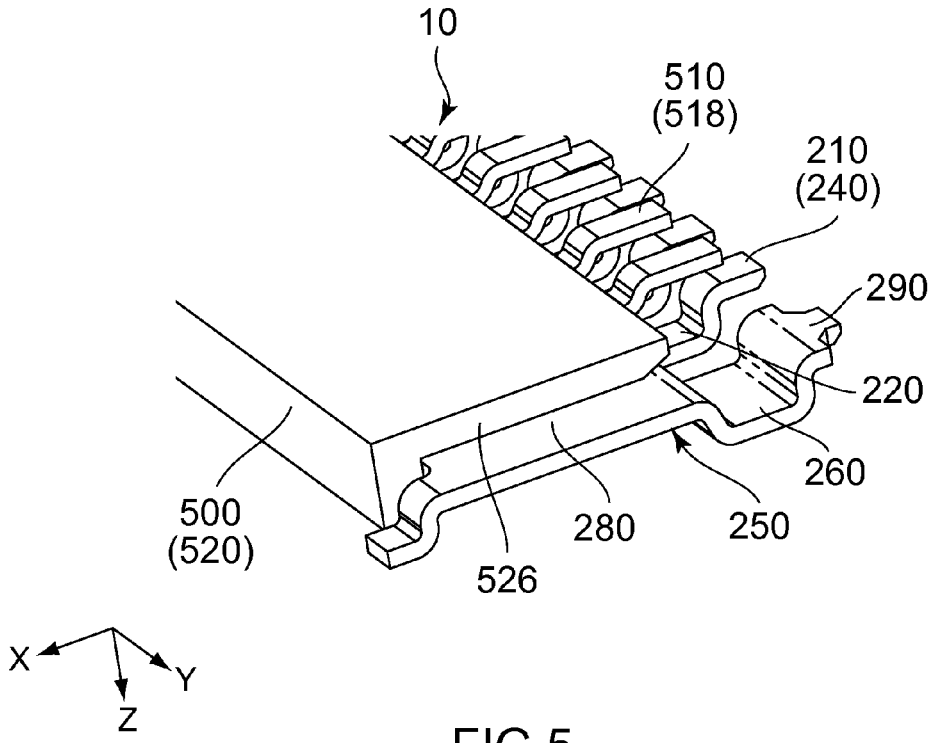
FIG. 5 is an enlarged, perspective view showing a part of the connector assembly of FIG. 2, wherein the connector and the mating connector are connected with each other.
Figure 6:
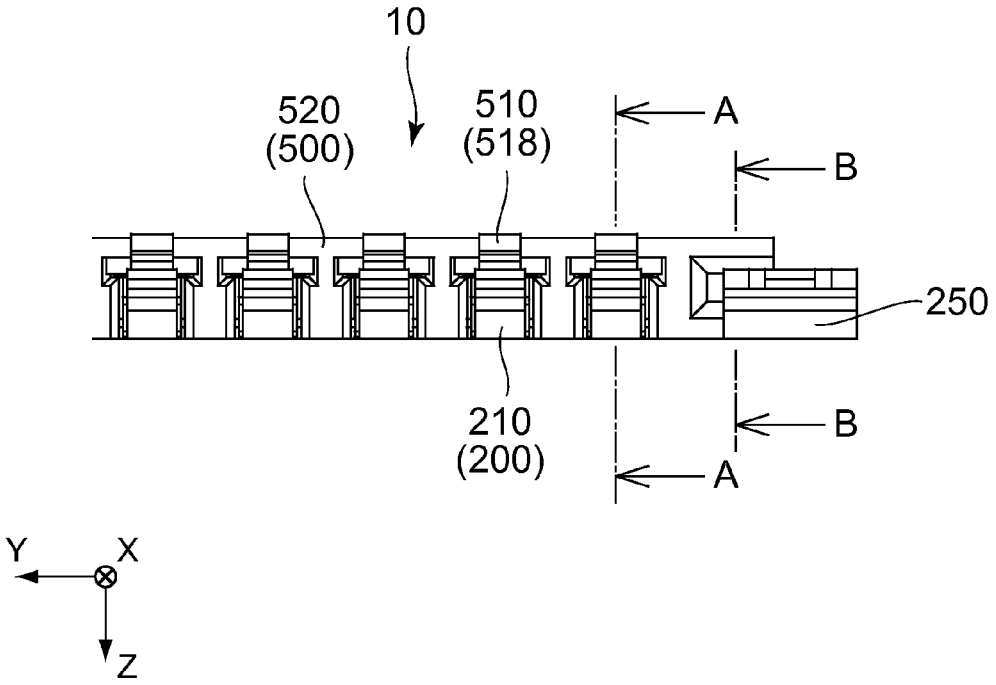
FIG. 6 is an enlarged, front view showing a part of the connector assembly of FIG. 2.

The second main portion 270 has a support portion 272 and a guide portion 280. The support portion 272 extends from the end 262 of the second soldered portion 260. The support portion 272 has an additional soldered portion 274 and an additional guide portion 276. The additional soldered portion 274 is located apart from the second soldered portion 260 in the X-direction. The additional soldered portion 274 is provided at an end of the support portion 272. When the connector 200 is fixed to the principal surface 110 of the connection object 100, the additional soldered portion 274 is soldered to the pad 112 provided on the principal surface 110. The additional guide portion 276 is formed of an edge which is located in the vicinity of the additional soldered portion 274 and faces inward in the Y-direction. As can be seen from FIGS. 4 and 5, the guide portion 280 is a portion which is to position the mating connector 500 in directions perpendicular to the X-direction, namely, the Y-direction and the Z-direction, and to guide the mating connector 500 along the X-direction. As shown in FIGS. 4 and 7, the guide portion 280 protrudes from the support portion 272 in the XY-plane (predetermined plane). When the connector 200 is fixed to the principal surface 110 of the connection object 100, the predetermined plane is in parallel to the principal surface 110. As can be seen from FIGS. 7 and 15, when the connector 200 is fixed to the principal surface 110, a space 284 is formed between the guide portion 280 and the principal surface 110. As shown in FIGS. 4 and 7, the guide portion 280 of the present embodiment extends in parallel to the XY-plane. The guide portion 280 has an edge face 282 in the Y-direction. The edge face 282 corresponds to the additional guided portion 524 (see FIG. 12) of the mating connector 500.

As can be seen from FIGS. 4 and 7, the contacts 210 and the guide members 250 of the present embodiment are obtained by punch-pressing a single metal plate. Accordingly, the first auxiliary portion 240 and the second auxiliary portion 290 have cross-sections same as each other in a plane perpendicular to the pitch direction.

As can be seen from FIGS. 1 and 8 to 11, in the present embodiment, a temporarily coupling portion 600 made of insulator is used in order for the contacts 210 and the guide members 250 to be soldered on the principal surface 110 of the connection object 100 all simultaneously.

Figure 8:
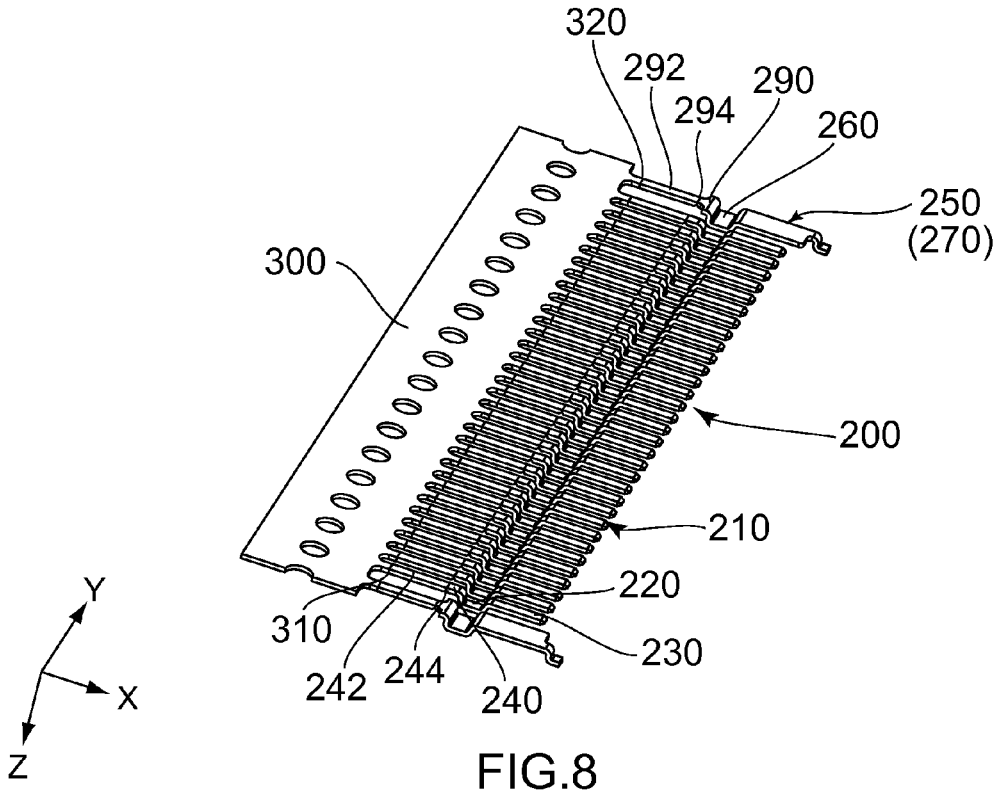
FIG. 8 is a perspective view showing the connector of FIG. 1, wherein the connector is connected to a carrier via first extensions and second extensions.

In detail, as shown in FIG. 8, the connector 200, which comprises the contacts 210 and the guide members 250, further comprises a plurality of first extensions 242 and two second extensions 292 under a state where the single metal plate is just pressed. As can be seen from FIG. 8, the contacts 210, the guide members 250, the first extensions 242 and the second extensions 292 constitute a single member, or the connector 200. In detail, when the connector 200 is not fixed to the principal surface 110 (see FIG. 1) of the connection object 100 yet, the first extensions 242 extend from the first auxiliary portions 240 of the contacts 210, respectively, and the second extensions 292 extend from the second auxiliary portions 290 of the guide members 250, respectively. The first extensions 242 and the second extensions 292 are connected to the carrier 300. For each of the first extensions 242, a boundary portion between the first extension 242 and the first auxiliary portion 240 of the contact 210 is formed with a notch 244. In addition, a boundary portion between each of the first extensions 242 and the carrier 300 is formed with a notch 310. Similarly, for each of the second extensions 292, a boundary portion between the second extension 292 and the second auxiliary portion 290 of the guide member 250 is formed with a notch 294. In addition, a boundary portion between each of the second extensions 292 and the carrier 300 is formed with a notch 320.

Figure 9:
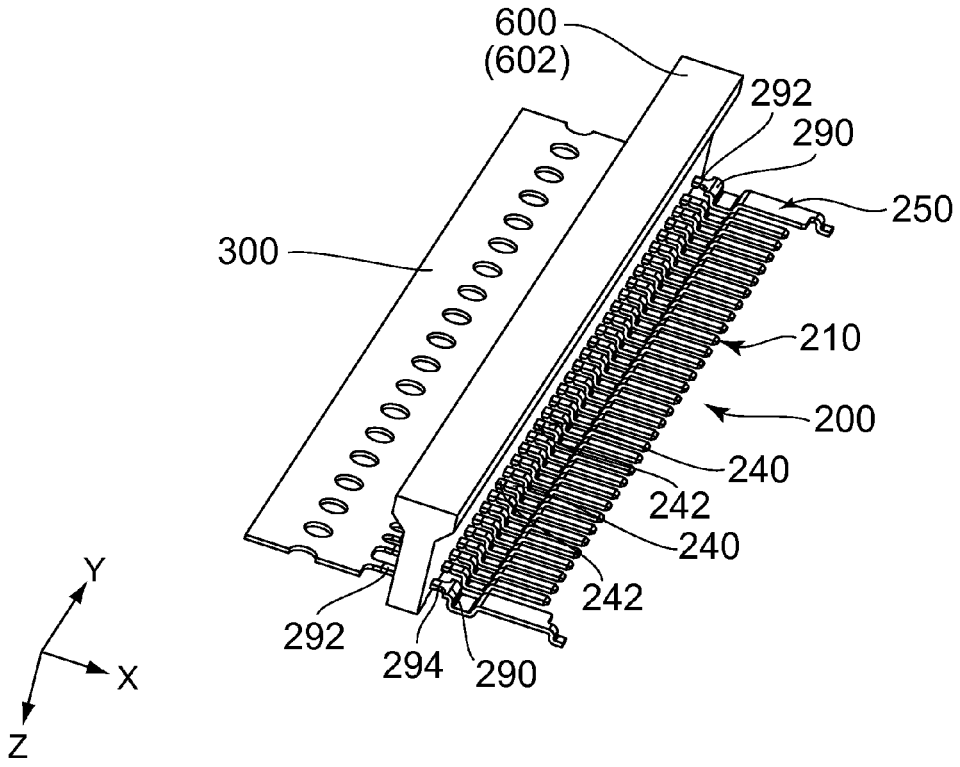
FIG. 9 is a perspective view showing the connector of FIG. 8, wherein the first extensions and the second extensions are coupled to one another by the carrier as well as coupled to one another by a temporarily coupling portion.

Referring to FIG. 9, the temporarily coupling portion 600 is formed via insert-molding. As a result, the first extensions 242 and the second extensions 292 are embedded in the temporarily coupling portion 600 to be coupled to one another. Under this state, the connector 200 further comprises the temporarily coupling portion 600. Moreover, under this state, the temporarily coupling portion 600 temporarily couples the first extensions 242 to one another and temporarily couples each of the second extensions 292 to the first extensions 242. Accordingly, the temporarily coupling portion 600 temporarily couples the first auxiliary portions 240 and the second auxiliary portions 290 to one another via the first extensions 242 and the second extensions 292. When the carrier 300 is cut off by using the notches 310 and the notches 320 (see FIG. 8), the connector 200 is in another state shown in FIG. 10.

Figure 10:
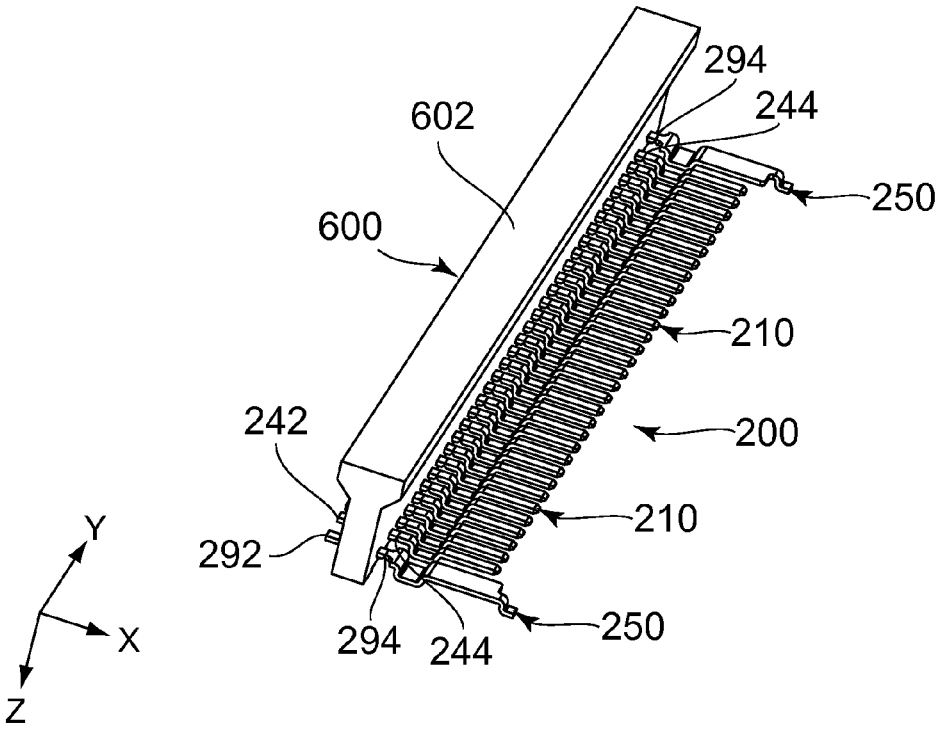
FIG. 10 is a perspective view showing the connector of FIG. 9, wherein the carrier is cut off, and the first extensions and the second extensions are coupled to one another by the temporarily coupling portion.

As shown in FIG. 10, when the connector 200 is not fixed to the principal surface 110 (see FIG. 1) of the connection object 100 yet, the temporarily coupling portion 600 couples the contacts 210 and the guide members 250 together. Because this temporarily coupling portion 600 is provided, the connector 200, which is constituted of the contacts 210 and the guide members 250 separable into pieces, can be easily handled. Moreover, the temporarily coupling portion 600 has a planar portion 602 which is relatively large. Accordingly, the connector 200 can be carried by sucking the planar portion 602.

Figure 11:
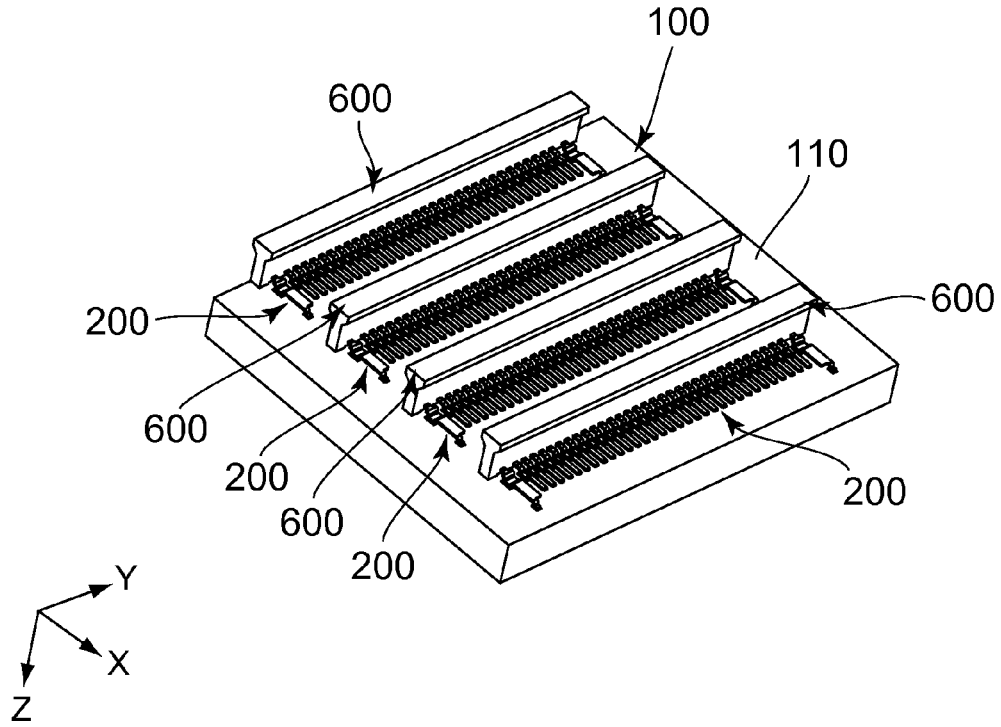
FIG. 11 is a perspective view showing a plurality of the connectors of FIG. 10, wherein each of the connectors is fixed to the connection object under a state where the first extensions and the second extensions are coupled to one another by the temporarily coupling portion.

As shown in FIG. 11, the connector 200, which is integrated together by the temporarily coupling portion 600, is mounted to a predetermined position of the principal surface 110 of the connection object 100. As can be seen from FIGS. 10 and 11, after the contacts 210 and the guide members 250 are soldered on the principal surface 110 under this state, the first extensions 242 and the second extensions 292 together with the temporarily coupling portion 600 are cut off from the first auxiliary portions 240 of the contacts 210 and the second auxiliary portions 290 of the guide members 250 by using the notches 244 and 294. As shown in FIG. 1, the contacts 210 and the guide members 250 are separated from one another by this operation. By the fixing method described above, the connector 200, which is constituted of the contacts 210 and the guide members 250 separated into pieces, can be fixed on the principal surface 110 of the connection object 100 all simultaneously.

The aforementioned connector 200 (see FIG. 1) and the mating connector 500 (see FIG. 3) are to be connected with each other as indicated by an arrow 1 and an arrow 2 shown in FIG. 3. First, as can be seen from FIGS. 1 and 3, the principal surface 110 of the connection object 100 and the principal surface 430 of the mating connection object 420 are arranged to face each other in the Z-direction. In detail, the rear surface 120 of the connection object 100 is located at the positive Z-side thereof while the principal surface 430 of the mating connection object 420 is located at the positive Z-side thereof. Then, the principal surface 110 and the principal surface 430 are brought nearer to each other in the Z-direction as indicated by the arrow 1. In the meantime, rough positioning is done by using the positive X-side two corners of the connection object 100 and the two markers 440 formed on the principal surface 430 of the mating connection object 420 (see FIG. 3). Then, as shown in FIGS. 14 to 17, the connector 200 and the mating connector 500 are connected with each other by moving the connection object 100 in the positive X-direction as indicated by the arrow 2. In the meantime, the portions for guiding, which include the guide portions 280 and the guided portions 522 (see FIG. 12), properly guide and move the connector 200 along the positive X-direction. In other words, these portions for guiding properly guide and move the connection object 100 along the positive X-direction.

In detail, when the connector 200 and the mating connector 500 start to be connected with each other, the chamfered portion 528 (see FIG. 12) is brought into contact with the additional guide portion 276 (see FIG. 7) so that the guided portion 522 is guided toward a proper position in the Y-direction. Then, the guided portion 522 is received into the space 284 formed at the negative Z-side of the guide portion 280 while the edge face 282 of the guide portion 280 together with the additional guided portion 524 adjust a relative position between the connector 200 and the mating connector 500 in the Y-direction. The mating connector 500 of the mating object 400 is thus guided to be connected with the connector 200. At that time, the guide portion 280 is inserted into the space 527 between the guided portion 522 and the auxiliary guided portion 526.

As shown in FIG. 16, under a state where the connector 200 and the mating connector 500 are connected with each other, the contact portion 232 is sandwiched between the mating contact portion 512 and the receiving portion 516 so that the contact 210 is connected to the mating contact 510. As can be seen from FIGS. 3, 14 and 15, in the present embodiment, the contact 210 and the mating contact 510 can be properly connected to each other by the function of the guide portion 280 and the guided portion 522, and there is no need to directly monitor a connected section between the contact 210 and the mating contact 510.

In addition, since the first auxiliary portion 240 and the second auxiliary portion 290 have cross-sections same as each other in the XZ-plane perpendicular to the Y-direction as previously described, the guide member 250 can be formed in pressing process for the formation of the contacts 210. In the present embodiment, the guide member 250 can be added to improve the operability in connection without causing extreme increase in cost.

Moreover, as previously described, the first auxiliary portion 240 and the second auxiliary portion 290 extend from the first soldered portion 220 and the second soldered portion 260, respectively, to be apart from the principal surface 110 of the connection object 100. Accordingly, there is no problem such that solder is moved to a space formed between each of the first auxiliary portion 240 and the second auxiliary portion 290 and the principal surface 110 of the connection object 100. Moreover, the boundary portion between the first auxiliary portion 240 and the first extension 242 is located apart from the principal surface 110, and the boundary portion between the second auxiliary portion 290 and the second extension 292 are also located apart from the principal surface 110. Accordingly, the temporarily coupling portion 600 can be easily cut off while the connection object 100 is prevented from being damaged.

Moreover, the first extension 242 and the second extension 292 are formed to be located not toward the first main portion 230 and the second main portion 270 but toward the first auxiliary portion 240 and the second auxiliary portion 290. Accordingly, even upon cutting-off of the temporarily coupling portion 600, the first main portion 230 and the second main portion 270 can be prevented from being deformed to shift the contact portion 232 and the guide portion 280 from their desirable positions. In other words, connection trouble between the connector 200 and the mating connector 500 due to the cutting-off of the temporarily coupling portion 600 can be prevented from being caused.

In particular, because the first auxiliary portion 240 and the second auxiliary portion 290 according to the present embodiment are shorter than the first main portion 230 and the second main portion 270, respectively, deformations of the first auxiliary portion 240 and the second auxiliary portion 290 are also suppressed even upon the cutting-off of the temporarily coupling portion 600.

Moreover, as previously described, each of the guide members 250 of the present embodiment has a size same as a size of the contact 210 in the Z-direction. Accordingly, under the state where the connector 200 is fixed to the connection object 100 as shown in FIG. 1, even if the connection object 100 is turned upside down to be mounted on a working platform or the like, the contact 210 can be prevented from being solely and directly brought into contact with the working platform to be damaged. From a view point of preventing the aforementioned damage, the guide member 250 may have a size larger than another size of the contact 210 in the Z-direction. In other words, when a size of each of the guide members 250 in the Z-direction is not less than another size of the contact 210 in the Z-direction, the contact 210 can be prevented from being solely and directly brought into contact with the working platform to be damaged.

Although the temporarily coupling portion 600 (see FIG. 10) is wholly cut off from the connector 200 in the aforementioned embodiment, the present invention is not limited thereto. The temporarily coupling portion 600 may be partially left, provided that the contacts 210 are separated from one another, and each of the guide members 250 is separated from the contact 210. In other words, it is sufficient that when the temporarily coupling portion 600 is cut off, at least in part, from the connector 200, the contacts 210 are separated from one another, and each of the guide members 250 is separated from the contacts 210.

Figure 18:
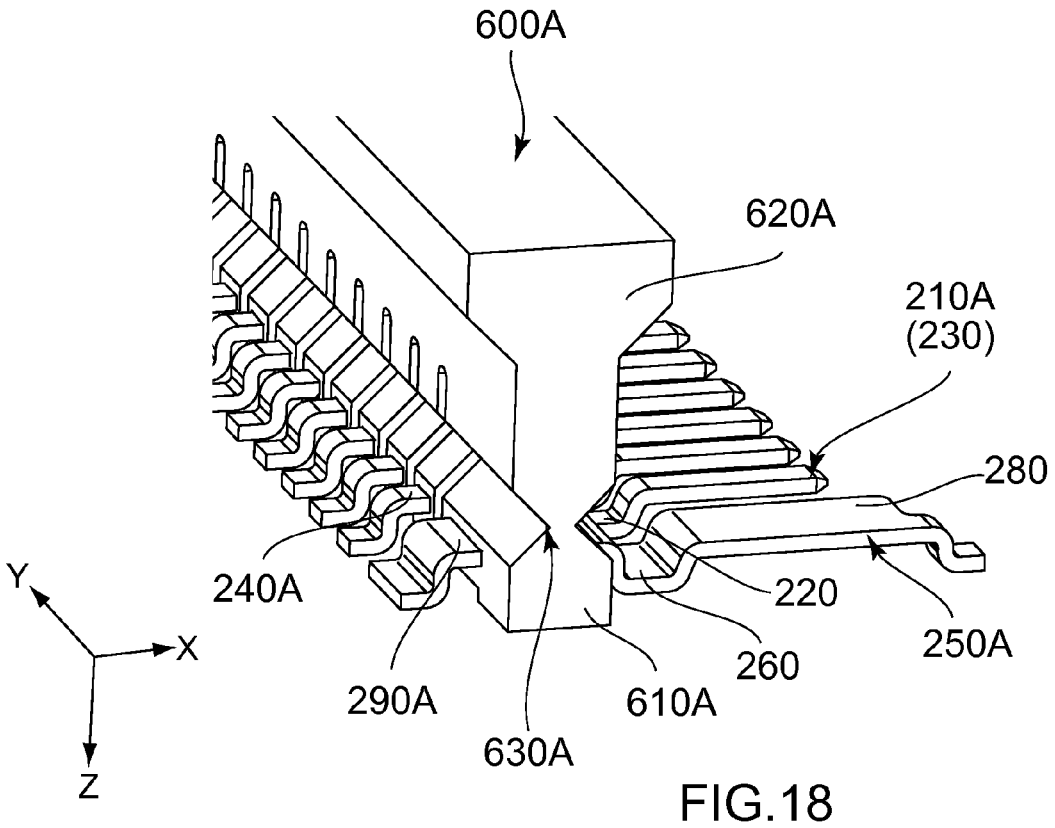
FIG. 18 is an enlarged, perspective view showing a part of a connector according to a modification.
Figure 19:
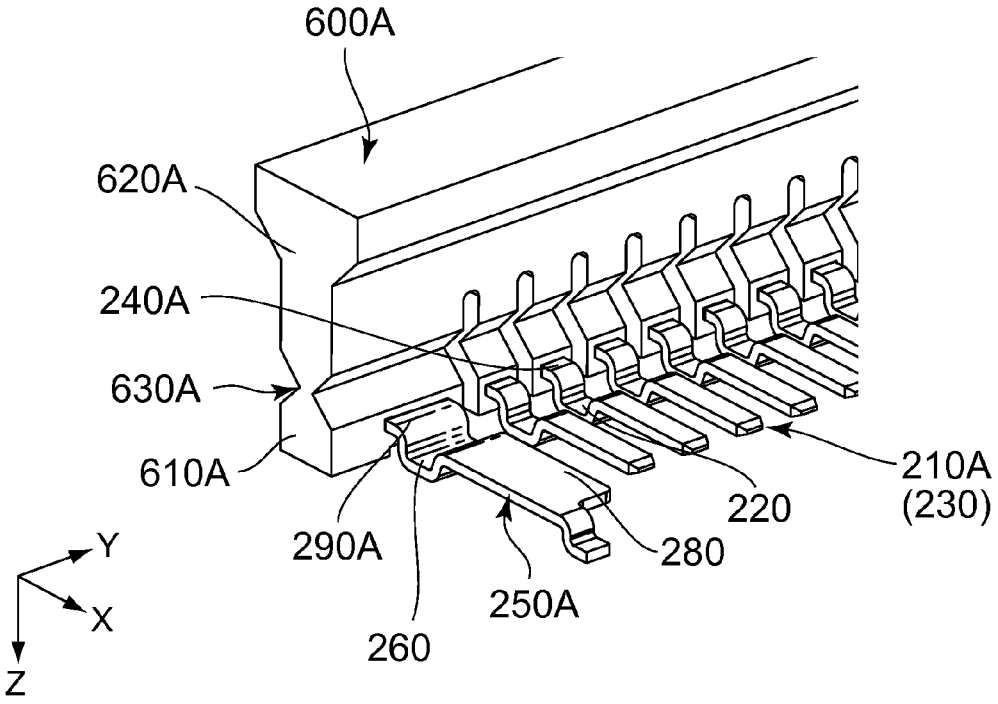
FIG. 19 is another enlarged, perspective view showing a part of the connector of FIG. 18.

More specifically, as shown in FIGS. 18 and 19, a temporarily coupling portion 600A according to a modification has a plurality of small portions 610A and a large portion 620A which temporarily couples the small portions 610A to one another. The small portions 610A hold the first auxiliary portions 240A of the contacts 210A and the second auxiliary portions 290A of the guide members 250A, respectively. The small portions 610A and the large portion 620A have boundary portions which are formed with notches 630A, respectively.

In such structure, after the contacts 210A and the guide members 250A are soldered to the principal surface 110 (see FIG. 1) of the connection object 100, the large portion 620A can be cut off from the small portions 610A by using the notches 630A. Accordingly, the contacts 210A, which are held by the small portions 610A, respectively, can be separated from one another, and each of the guide members 250A can be separated from the contacts 210A.

Although the connection direction and the predetermined direction are the same direction (X-direction) as each other in the aforementioned embodiment, the two directions may be different from each other. For example, the connection direction may be perpendicular to the predetermined direction.

Moreover, although the guided portion 522 is provided to the mating connector 500 in the aforementioned embodiment, the guided portion 522 may be provided to a member other than the mating connector 500, provided that the guided portion 522 is provided as a part of the mating object 400. For example, the guided portion may be provided to the mating connection object 420 or may be provided to a member which is prepared as another member included in the mating object 400.

Second Embodiment

Hereafter, explanation will be made about a second embodiment of the present invention as referring to Figures, wherein a connection direction is different from a predetermined direction, and a guide portion is formed on a member other than the mating connector.

Figure 20:
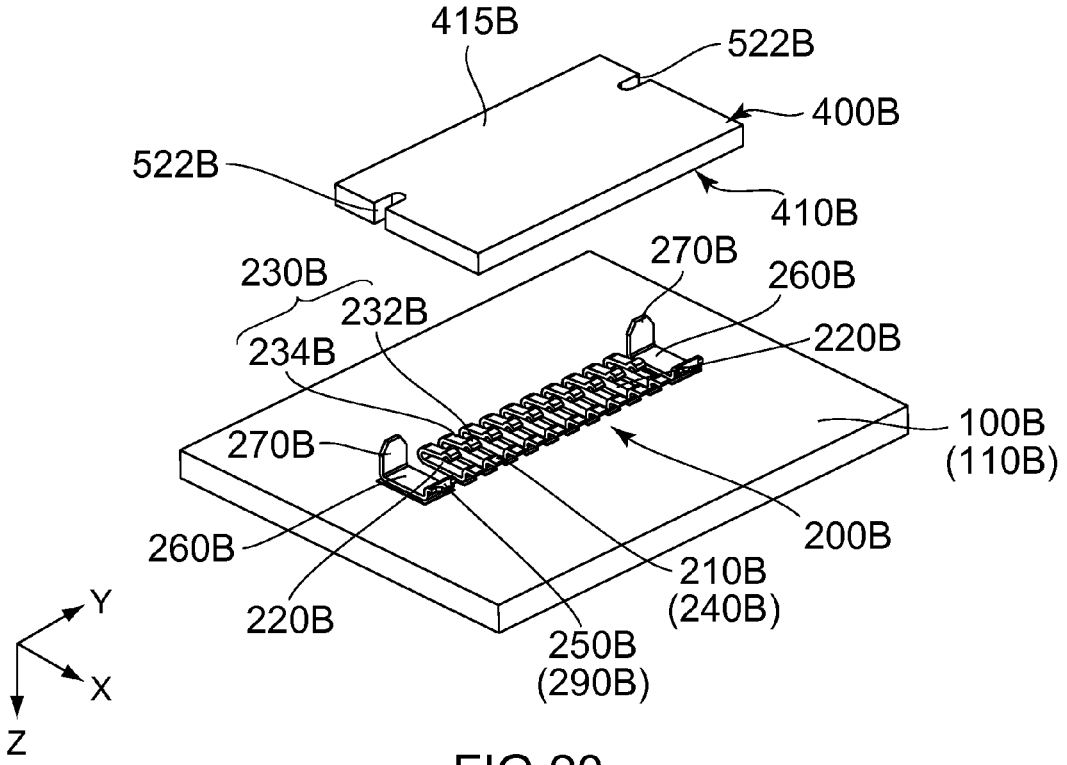
FIG. 20 is a perspective view showing a connector and a mating object according to a second embodiment of the present invention, wherein the connector and the mating object are unconnected with each other.
Figure 21:
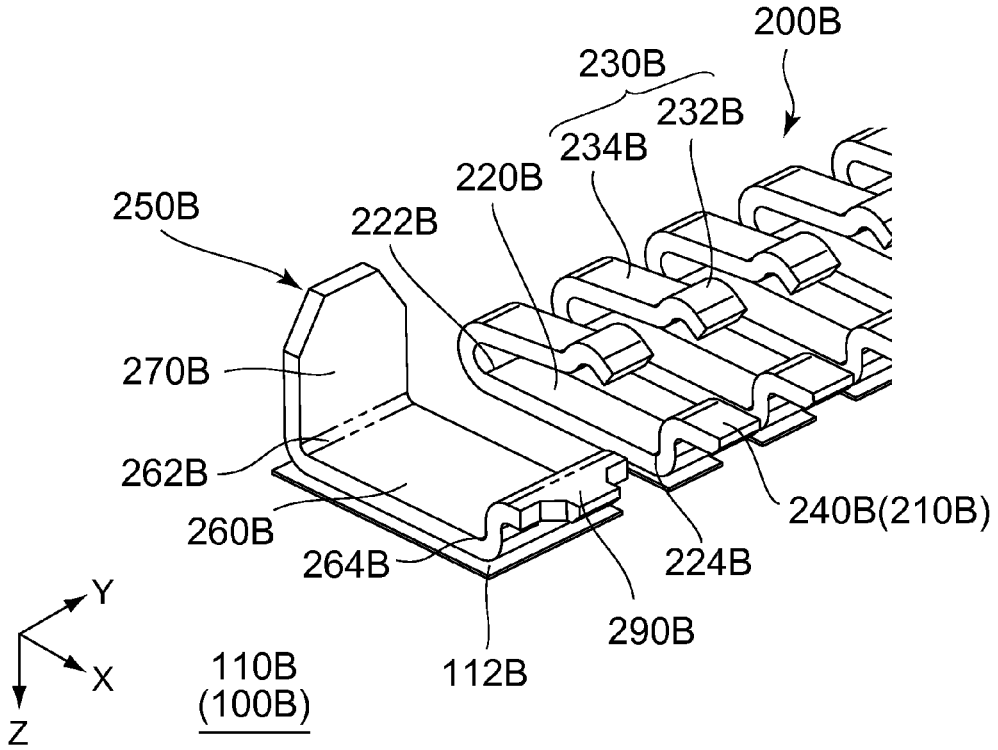
FIG. 21 is an enlarged, perspective view showing contacts and a guide member of the connector of FIG. 20.

Referring to FIGS. 20 and 21, a connector 200B according to the present embodiment is to be fixed to a principal surface 110B of a connection object 100B. The connection object 100B of the present embodiment is a semiconductor package. In the present embodiment, only one connector 200B is fixed to the connection object 100B. However, the present invention is not limited thereto.

Figure 23:
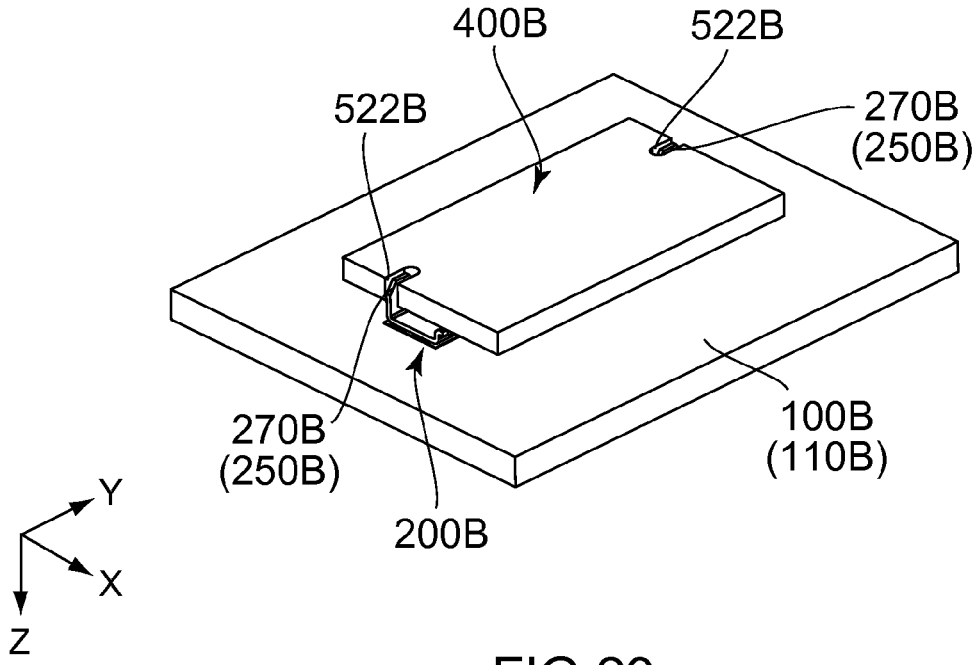
FIG. 23 is a perspective view showing the connector and the mating object of FIG. 20, wherein the connector and the mating object are connected with each other.

As can be seen from FIGS. 20 and 23, the connector 200B can be connected with a mating object 400B in the Z-direction. In other words, in the present embodiment, a connection direction along which the connector 200B and the mating object 400B are connected with each other is the Z-direction.

Figure 22:
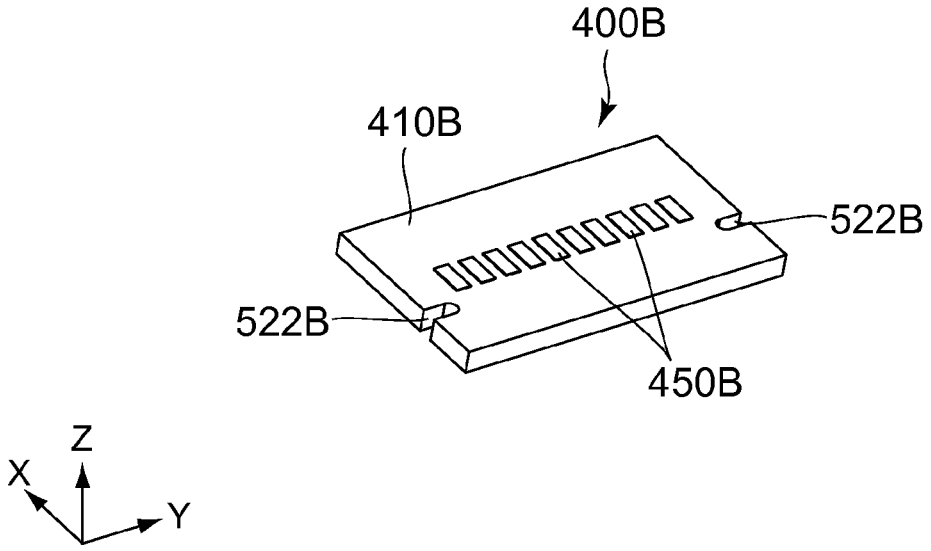
FIG. 22 is a perspective view showing the mating object of FIG. 20.

As can be seen from FIGS. 20, 22 and 23, the mating object 400B of the present embodiment consists of a circuit board and comprises no mating connector. As shown in FIG. 22, the mating object 400B has a plurality of mating contact portions 450B formed on a principal surface 410B thereof. The mating contact portions 450B are arranged in a row in the Y-direction (pitch direction). In addition, the mating object 400B is provided with two guided portions 522B. The guided portions 522B are formed at opposite edges of the mating object 400B in the Y-direction, respectively, and recessed inward in the Y-direction.

As shown in FIGS. 20 and 21, the connector 200B of the present embodiment comprises a plurality of contacts 210B and two guide members 250B.

As shown in FIG. 20, the contacts 210B are arranged in a row in the Y-direction, and the guide members 250B are located at opposite sides of the row of the contacts 210B in the Y-direction, respectively. In other words, the contacts 210B are located between the two guide members 250B in the Y-direction. As shown in FIGS. 20 and 21, when the connector 200B is fixed to the principal surface 110B of the connection object 100B, the contacts 210B are soldered to the principal surface 110B while being separated from one another, and each of the guide members 250B is soldered to the principal surface 110B while being separated from the contacts 210B. In other words, each of the contacts 210B and the guide members 250B is integrated with neither other contacts 210B nor other guide members 250B and is soldered to the principal surface 110B of the connection object 100B while being separated into pieces.

As shown in FIG. 21, each of the contacts 210B has a first soldered portion 220B, a first main portion 230B and a first auxiliary portion 240B. The first soldered portion 220B has two ends 222B and 224B in the X-direction (predetermined direction). When the connector 200B is fixed to the principal surface 110B of the connection object 100B, the first soldered portion 220B is soldered to a pad 112B provided on the principal surface 110B, and the predetermined direction extends in parallel to the principal surface 110B. As can be seen from this explanation, the predetermined direction (X-direction) of the present embodiment is perpendicular to the connection direction (Z-direction). The first main portion 230B extends from the end 222B which is one of the opposite ends of the first soldered portion 220B. The first main portion 230B has a contact portion 232B and a spring portion 234B, wherein the contact portion 232B is to be brought into contact with the mating object 400B, and the spring portion 234B resiliently supports the contact portion 232B. The contact portion 232B is movable mainly in the Z-direction by using resilience of the spring portion 234B. The first auxiliary portion 240B extends from the end 224B which is a remaining one of the opposite ends of the first soldered portion 2206. In detail, the first auxiliary portion 240B extends from the first soldered portion 220B to be apart from the principal surface 110B.

As can be seen from FIGS. 20 and 21, each of the guide members 250B has a second soldered portion 260B, a second main portion 270B and a second auxiliary portion 290B. The second soldered portion 2606 has two ends 262B, 264B in the X-direction. When the connector 200B is fixed to the principal surface 110B of the connection object 100B, the second soldered portion 260B is soldered to the pad 112B provided on the principal surface 110B. The second main portion 270B extends along the negative Z-direction from the end 262B which is one of the opposite ends of the second soldered portion 260B. The second main portion 270B of the present embodiment functions as a guide portion by itself. The second auxiliary portion 290B extends from the end 264B which is a remaining one of the opposite ends of the second soldered portion 260B. In detail, the second auxiliary portion 290B extends from the second soldered portion 260B to be apart from the principal surface 110B.

As can be seen from FIG. 21, the contacts 210B and the guide members 250B of the present embodiment are obtained by punch-pressing a single metal plate. Accordingly, the first auxiliary portion 240B and the second auxiliary portion 290B have cross-sections same as each other in a plane perpendicular to the pitch direction.

Figure 24:
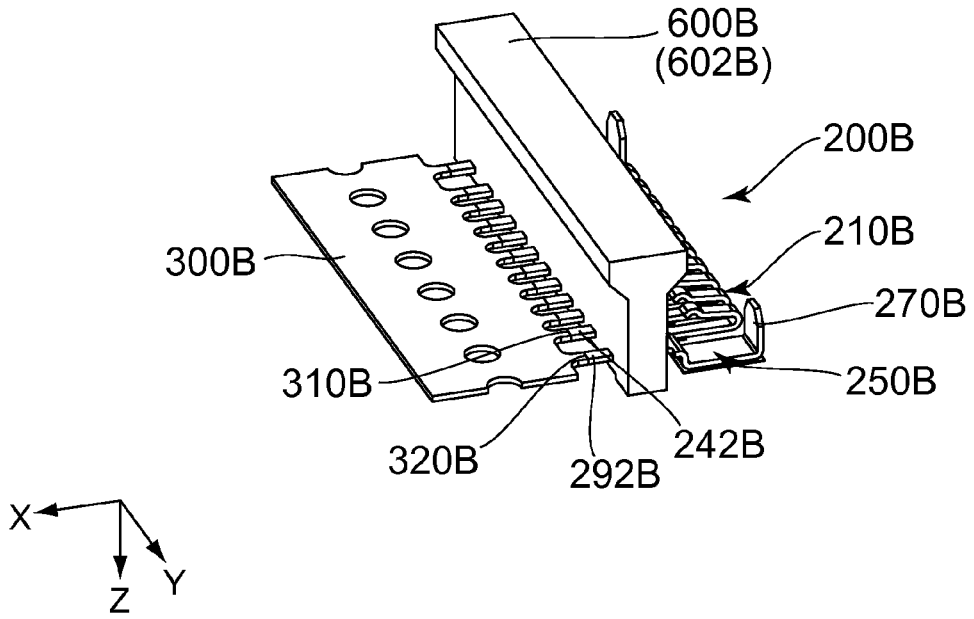
FIG. 24 is a perspective view showing the connector of FIG. 20, wherein first extensions and second extensions are coupled to one another by a carrier as well as coupled to one another by a temporarily coupling portion.
Figure 25:
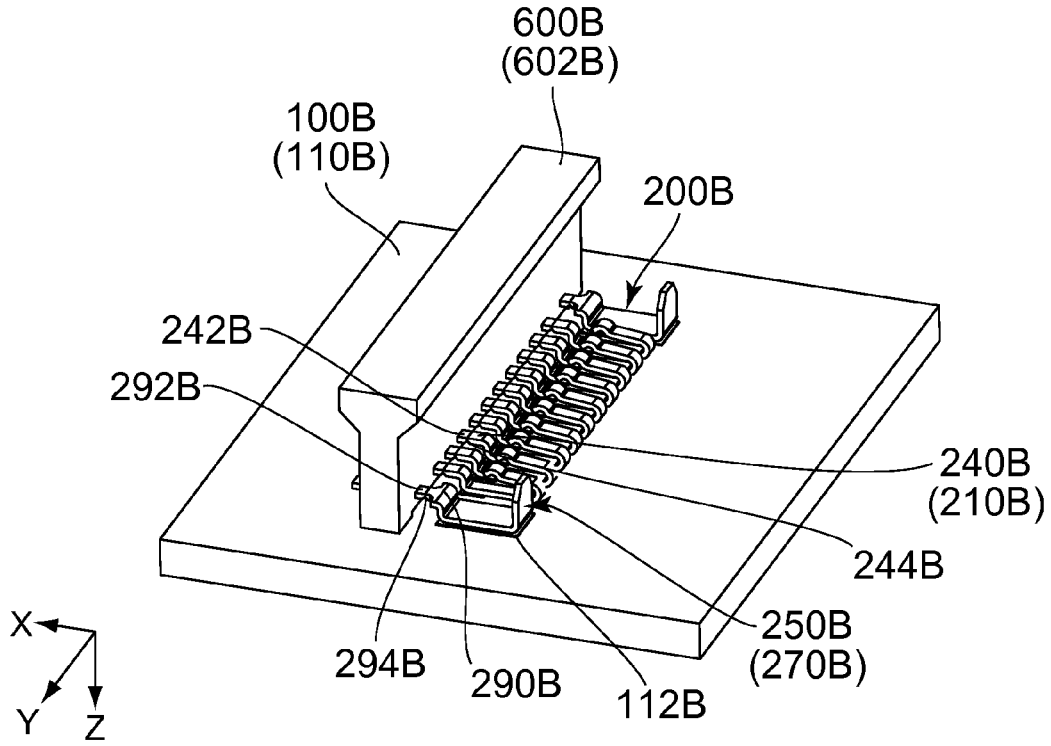
FIG. 25 is a perspective view showing the connector of FIG. 24, wherein the carrier is cut off, and the first extensions and the second extensions are coupled to one another by the temporarily coupling portion.
Figure 26:
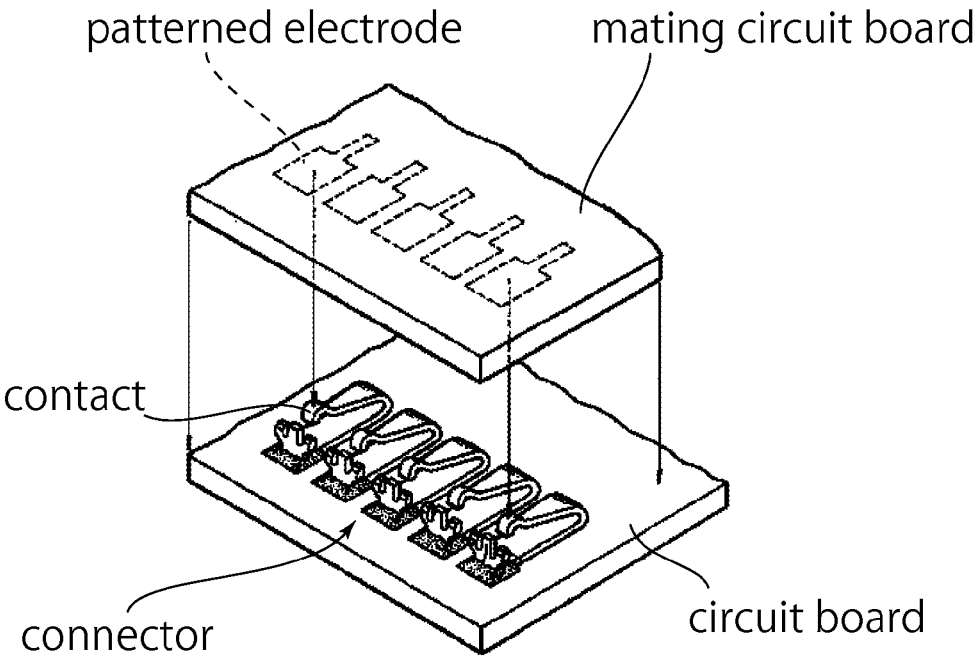
FIG.26 PRIOR ART
FIG. 26 is a perspective view showing a connector of Patent Document 1.

As can be seen from FIGS. 20, 24 and 25, in the present embodiment, a temporarily coupling portion 600B made of insulator is used in order for the contacts 210B and the guide members 250B to be collectively soldered on the principal surface 110B of the connection object 100B all simultaneously.

In detail, as can be seen from FIG. 24, the connector 200B, which comprises the contacts 210B and the guide members 250B, further comprises a plurality of first extensions 242B and two second extensions 292B under a state where the single metal plate is just pressed. The first extensions 242B extend from the first auxiliary portions 240B of the contacts 210B, respectively, and the second extensions 292B extend from the second auxiliary portions 290B of the guide members 250B, respectively. The first extensions 242B and the second extensions 292B are connected to the carrier 300B. As shown in FIG. 25, for each of the first extensions 242, a boundary portion between the first extension 242B and the first auxiliary portion 240B of the contact 210B is formed with a notch 244B. In addition, as shown in FIG. 24, a boundary portion between each of the first extensions 242B and the carrier 300B is formed with a notch 310B. Similarly, as shown in FIG. 25, for each of the second extensions 292B, a boundary portion between the second extension 292B and the second auxiliary portion 290B of the guide member 250B is formed with a notch 294B. In addition, as shown in FIG. 24, a boundary portion between each of the second extensions 292B and the carrier 300B is formed with a notch 320B.

Referring to FIG. 24, the temporarily coupling portion 600B is formed via insert-molding also in the present embodiment. As a result, the first extensions 242B and the second extensions 292B are embedded in the temporarily coupling portion 600B to be coupled to one another. Accordingly, the temporarily coupling portion 600B temporarily couples the first auxiliary portion 240B and the second auxiliary portions 290B to one another via the first extension 242B and the second extensions 292B.

As shown in FIG. 25, after the carrier 300B is cut off by using the notches 310B and the notches 320B, the connector 200B is mounted and soldered to the principal surface 110B of the connection object 100B. As can be seen from FIG. 25, since the temporarily coupling portion 600B couples the contacts 210B and the guide members 250B together, the connector 200B, which is constituted of the contacts 210B and the guide members 250B separable into pieces, can be easily handled. Because the temporarily coupling portion 600B has a planar portion 602B which is relatively large also in the present embodiment, the connector 200B can be easily carried by sucking the planar portion 602B.

As can be seen from FIGS. 20 and 25, after the contacts 210B and the guide members 250B are soldered on the principal surface 110B, the first extensions 242B and the second extensions 292B together with the temporarily coupling portion 600B are cut off from the contacts 210B and the guide members 250B by using the notches 244B and 294B. As shown in FIG. 20, the contacts 210B and the guide members 250B are separated from one another by this operation. According to the present embodiment, the connector 200B, which is constituted of the contacts 210B and the guide members 250B separated into pieces, can be fixed on the principal surface 110B of the connection object 100B all simultaneously.

As can be seen from FIGS. 20 and 23, the connector 200B and the mating object 400B are to be connected with each other along the Z-direction. First, the principal surface 410B of the mating object 400B and the principal surface 110B of the connection object 100B are arranged to face each other. In detail, the principal surface 110B of the connection object 100B is located at the negative Z-side thereof while the rear surface 415B of the mating object 400B is located at the negative Z-side thereof. Then, the principal surface 110B and the principal surface 410B are brought nearer to each other along the Z-direction. In the meantime, because the guide portions 270B guide the guided portions 522B, the mating object 400B is properly positioned relative to the connector 200B in the XY-plane. Accordingly, the contact 210B and the mating contact portion 450B (see FIG. 22) can be properly connected to each other, and there is no need to directly monitor a connected section between the contact 210B and the mating contact portion 450B.

Although the specific explanation about the present invention is made above referring to the embodiments, the present invention is not limited thereto.

Although the number of the guide members (the guide member 250, 250A or 250B) in the aforementioned embodiments is two, the present invention is not limited thereto. The connector (the connector 200 or 200B) may be provided with only one guide member or provided with three or more guide members. However, when the guide member is required to protect the contact (the contact 210, 210A or 210B), the number of the guide members needs to be two or more.

The present application is based on a Japanese patent application of JP2014-107059 filed before the Japan Patent Office on May 23, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector adapted to be fixed to a principal surface of a connection object and to be connected with a mating object in a connection direction, the mating object comprising a guided portion, wherein:

the connector comprises a plurality of contacts and a guide member;

the contacts and the guide member are obtained by punch-pressing a single metal plate;

each of the contacts has a first soldered portion, a first main portion and a first auxiliary portion;

the first soldered portion has two ends in a predetermined direction;

the first main portion extends from one of the ends of the first soldered portion and has a contact portion;

the contact portion is a portion adapted to be brought into contact with the mating object;

the first auxiliary portion extends from a remaining one of the ends of the first soldered portion;

the guide member has a second soldered portion, a second main portion and a second auxiliary portion;

the second soldered portion has two ends in the predetermined direction;

the second main portion extends from one of the ends of the second soldered portion and has a guide portion;

the guide portion is a portion adapted to position the mating object in a direction perpendicular to the connection direction and to guide the mating object along the connection direction;

the second auxiliary portion extends from a remaining one of the ends of the second soldered portion;

when the connector is fixed to the principal surface, the first soldered portions and the second soldered portion are soldered to the principal surface, the predetermined direction extends in parallel to the principal surface, the contacts are arranged in a pitch direction perpendicular to the predetermined direction while being separated from one another, and the guide member is separated from the contacts; and the first auxiliary portion and the second auxiliary portion have same cross-sections in a plane perpendicular to the pitch direction;

the connection direction is a same direction as the predetermined direction;

the second main portion further has a support portion which extends from the second soldered portion;

the guide portion protrudes from the support portion in a predetermined plane;

when the connector is fixed to the principal surface, the predetermined plane is in parallel to the principal surface, and a space is formed between the guide portion and the principal surface; and when the connector is connected with the mating object, the guided portion is received into the space.

2. The connector as recited in claim 1, wherein:

the first auxiliary portion extends from the first soldered portion to be apart from the principal surface; and the second auxiliary portion extends from the second soldered portion to be apart from the principal surface.

3. The connector as recited in claim 1, wherein:

the support portion has an additional soldered portion; and the additional soldered portion is located apart from the second soldered portion in the predetermined direction.

4. The connector as recited in claim 1, wherein:

the mating object comprises a mating connection object and a mating connector which is to be fixed to the mating connection object; and the mating connector is provided with the guided portion.

5. A connector adapted to be fixed to a principal surface of a connection object and to be connected with a mating object in a connection direction, the mating object comprising a guided portion, wherein:

the connector comprises a plurality of contacts and a guide member;

the contacts and the guide member are obtained by punch-pressing a single metal plate;

each of the contacts has a first soldered portion, a first main portion and a first auxiliary portion;

the first soldered portion has two ends in a predetermined direction;

the first main portion extends from one of the ends of the first soldered portion and has a contact portion;

the contact portion is a portion adapted to be brought into contact with the mating object;

the first auxiliary portion extends from a remaining one of the ends of the first soldered portion;

the guide member has a second soldered portion, a second main portion and a second auxiliary portion;

the second soldered portion has two ends in the predetermined direction;

the second main portion extends from one of the ends of the second soldered portion and has a guide portion;

the guide portion is a portion adapted to position the mating object in a direction perpendicular to the connection direction and to guide the mating object along the connection direction;

the second auxiliary portion extends from a remaining one of the ends of the second soldered portion;

when the connector is fixed to the principal surface, the first soldered portions and the second soldered portion are soldered to the principal surface, the predetermined direction extends in parallel to the principal surface, the contacts are arranged in a pitch direction perpendicular to the predetermined direction while being separated from one another, and the guide member is separated from the contacts;

the first auxiliary portion and the second auxiliary portion have same cross-sections in a plane perpendicular to the pitch direction;

the connector comprises at least two of the guide members; and when the connector is fixed to the principal surface, a size of the guide member in a perpendicular direction perpendicular to the principal surface is not less than another size of the contact in the perpendicular direction.

6. A connector adapted to be fixed to a principal surface of a connection object and to be connected with a mating object in a connection direction, the mating object comprising a guided portion, wherein:

the connector comprises a plurality of contacts and a guide member;

the contacts and the guide member are obtained by punch-pressing a single metal plate;

each of the contacts has a first soldered portion, a first main portion and a first auxiliary portion;

the first soldered portion has two ends in a predetermined direction;

the first main portion extends from one of the ends of the first soldered portion and has a contact portion;

the contact portion is a portion adapted to be brought into contact with the mating object;

the first auxiliary portion extends from a remaining one of the ends of the first soldered portion;

the guide member has a second soldered portion, a second main portion and a second auxiliary portion;

the second soldered portion has two ends in the predetermined direction;

the second main portion extends from one of the ends of the second soldered portion and has a guide portion;

the guide portion is a portion adapted to position the mating object in a direction perpendicular to the connection direction and to guide the mating object along the connection direction;

the second auxiliary portion extends from a remaining one of the ends of the second soldered portion;

when the connector is fixed to the principal surface, the first soldered portions and the second soldered portion are soldered to the principal surface, the predetermined direction extends in parallel to the principal surface, the contacts are arranged in a pitch direction perpendicular to the predetermined direction while being separated from one another, and the guide member is separated from the contacts;

the first auxiliary portion and the second auxiliary portion have same cross-sections in a plane perpendicular to the pitch direction;

the connector further comprises a temporarily coupling portion;

the temporarily coupling portion temporarily couples the first auxiliary portions and the second auxiliary portion to one another; and when the temporarily coupling portion is cut off, at least in part, from the connector, the contacts are separated from one another, and the guide member is separated from the contacts.

7. The connector as recited in claim 6, wherein:

the connector further comprises a plurality of first extensions and a second extension;

the first extensions extend from the first auxiliary portions, respectively;

the second extension extends from the second auxiliary portion;

the first extensions and the second extension are obtained from the single metal plate;

the temporarily coupling portion temporarily couples the first extensions to one another and temporarily couples the second extension to the first extensions; and when the first extensions and the second extension together with the temporarily coupling portion are cut off from the first auxiliary portions and the second auxiliary portion, the contacts are separated from one another, and the guide member is separated from the contacts.

8. A connector assembly comprising a connector and a mating connector, wherein the connector is adapted to be fixed to a principal surface of a connection object and to be connected with a mating object in a connection direction, wherein the mating object comprises a mating connection object and the mating connector which is adapted to be fixed to the mating connection object, wherein the mating connector is provided with a guided portion, and wherein:

the connector comprises a plurality of contacts and a guide member;

the contacts and the guide member are obtained by punch-pressing a single metal plate;

each of the contacts has a first soldered portion, a first main portion and a first auxiliary portion;

the first soldered portion has two ends in a predetermined direction;

the first main portion extends from one of the ends of the first soldered portion and has a contact portion;

the contact portion is a portion adapted to be brought into contact with the mating object;

the first auxiliary portion extends from a remaining one of the ends of the first soldered portion;

the guide member has a second soldered portion, a second main portion and a second auxiliary portion;

the second soldered portion has two ends in the predetermined direction;

the second main portion extends from one of the ends of the second soldered portion and has a guide portion;

the guide portion is a portion adapted to position the mating object in a direction perpendicular to the connection direction and to guide the mating object along the connection direction;

the second auxiliary portion extends from a remaining one of the ends of the second soldered portion;

when the connector is fixed to the principal surface, the first soldered portions and the second soldered portion are soldered to the principal surface, the predetermined direction extends in parallel to the principal surface, the contacts are arranged in a pitch direction perpendicular to the predetermined direction while being separated from one another, and the guide member is separated from the contacts;

the first auxiliary portion and the second auxiliary portion have same cross-sections in a plane perpendicular to the pitch direction;

the guide portion has an edge face in the pitch direction; and the mating connector is provided with an additional guided portion which corresponds to the edge face of the guide portion.

9. A connector assembly comprising a connector and a mating connector, wherein the connector is adapted to be fixed to a principal surface of a connection object and to be connected with a mating object in a connection direction, wherein the mating object comprises a mating connection object and the mating connector which is adapted to be fixed to the mating connection object, wherein the mating connector is provided with a guided portion, and wherein:

the connector comprises a plurality of contacts and a guide member;

the contacts and the guide member are obtained by punch-pressing a single metal plate;

each of the contacts has a first soldered portion, a first main portion and a first auxiliary portion;

the first soldered portion has two ends in a predetermined direction;

the first main portion extends from one of the ends of the first soldered portion and has a contact portion;

the contact portion is a portion adapted to be brought into contact with the mating object:

the first auxiliary portion extends from a remaining one of the ends of the first soldered portion;

the guide member has a second soldered portion, a second main portion and a second auxiliary portion;

the second soldered portion has two ends in the predetermined direction;

the second main portion extends from one of the ends of the second soldered portion and has a guide portion;

the guide portion is a portion adapted to position the mating object in a direction perpendicular to the connection direction and to guide the mating object along the connection direction;

the second auxiliary portion extends from a remaining one of the ends of the second soldered portion;

when the connector is fixed to the principal surface, the first soldered portions and the second soldered portion are soldered to the principal surface, the predetermined direction extends in parallel to the principal surface, the contacts are arranged in a pitch direction perpendicular to the predetermined direction while being separated from one another, and the guide member is separated from the contacts;

the first auxiliary portion and the second auxiliary portion have same cross-sections in a plane perpendicular to the pitch direction;

the mating connector is further provided with an auxiliary guided portion;

the auxiliary guided portion is located apart from the guided portion in a direction perpendicular to the connection direction; and when the connector and the mating connector are connected with each other, the guide portion is inserted between the guided portion and the auxiliary guided portion.

* * * * *